US005664494A

United States Patent [19]

Hoeh

[11] Patent Number: 5,664,494

[45] Date of Patent: Sep. 9, 1997

[54] MODULAR PRESS INCLUDING NON-CAST OR STOCK PARTS REMOVABLY SECURED WITH ONE ANOTHER

[76] Inventor: James A. Hoeh, 33 N. Seventh St., Sebewaing, Mich. 48759

[21] Appl. No.: 391,435

[22] Filed: Feb. 21, 1995

[51] Int. Cl.[6] ..... B30B 15/04

[52] U.S. Cl. ..... 100/214; 100/231

[58] Field of Search ..... 100/214, 231, 100/269.01, 269.17; 156/583.6, 583.7

[56] References Cited

U.S. PATENT DOCUMENTS

| | | | |
|---|---|---|---|
| 143,410 | 10/1873 | Heitkamp | 100/231 |
| 152,350 | 6/1874 | Dubrul et al. | 100/231 |
| 887,783 | 5/1908 | Francis | 100/214 |
| 2,502,072 | 3/1950 | Bender | 100/214 |
| 3,247,783 | 4/1966 | Hammon | 100/214 |
| 3,307,830 | 3/1967 | Van Allen | 100/214 |
| 3,613,764 | 10/1971 | Guenard | 100/231 |
| 4,018,150 | 4/1977 | Shiokawa | 100/231 |
| 4,173,181 | 11/1979 | Beneteau | 100/231 |
| 4,448,119 | 5/1984 | Williamson | 100/231 |
| 4,686,897 | 8/1987 | Frank | 100/231 |

FOREIGN PATENT DOCUMENTS

| | | | |
|---|---|---|---|
| 301779 | 12/1928 | United Kingdom | 100/231 |
| 992212 | 5/1965 | United Kingdom | 100/214 |
| 90/06843 | 6/1990 | WIPO | 100/214 |

*Primary Examiner*—Stephen F. Gerrity
*Attorney, Agent, or Firm*—Harness, Dickey & Pierce, P.L.C.

[57] ABSTRACT

A press has modular components which are removable secured together to provide a C-shaped or gap frame press. The base portion includes a bed which is keyed and bolted to lower beam frames. Supports are keyed and bolted to the bed and an upper plate is keyed and bolted to the uprights. A ram assembly is removably coupled with the upper plate and its movement is controlled to carry out a desired operation.

19 Claims, 5 Drawing Sheets

10
12
14
16
18
20
22
24
26
28
30
32
34
36
38
40
42
44
46
48
50
52
54
56
58
60
62
64
66
68
70
80
82
84
86
88
90
92
94
96
98
100
102
104
106
108
110
112
114
116
118
120
122
124
126
128
132
134
136
138
140
142
146
148
150
152
154
156
158
160
162
164
166
168
170
172
174

MODULAR PRESS INCLUDING NON-CAST OR STOCK PARTS REMOVABLY SECURED WITH ONE ANOTHER

BACKGROUND AND SUMMARY OF THE INVENTION

The present invention relates to presses and preferably to gap frame hydraulic presses formed from modular parts.

Machines that are used to form, trim, blank and perforate metal sheets, strips, bars etc. are commonly called punch presses. Punch presses are manufactured in various configurations best suited for the particular product it is to produce. The main frame work of most punch presses is made of iron castings or steel plates joined together by welding and are called fabrications or weldments.

Pound for pound steel is much stronger that iron especially when subject to stretching or bending forces. Thus, a fabricated steel press of the same capacity as an iron press would weigh considerably less than a press made from iron castings.

The actual labor cost to manufacture a punch press from iron castings is a great deal less than the labor required to produce weldments, heat treat, and finish machine a steel press. This is due to the fact that the iron is cast to the final net shape of components and only needs to be finish machined on mating surfaces.

In order to produce an iron casting, it is necessary to manufacture a pattern of the same shape from suitable material. Once a pattern is made it can be used over and over again to produce that particular casting. These patterns are very costly and unless they can be used a certain minimum number of times it would be more economical to manufacture the press from steel weldments.

In the case of castings for punch presses the pattern is implanted in sand then removed and molten iron is poured into the cavity formed by the pattern. Intricate shapes are produced by this process. Steel can also be cast by this process and would be superior to iron for this purpose, but, molten steel is much more difficult to cast into intricate shapes than molten iron because molten iron pours like water and molten steel pours like syrup. Also, molten steel breaks down the sand mold much more than molten iron especially in the upper portion of the sand mold, this causes the molten steel to mix with the sand in these areas and reduces the quality of the material in the areas wherever the molten steel mixed with the sand. Cast steel is also much more difficult and costly to machine than cast iron.

The above disadvantages with cast steel are greatly reduced if the design of the product is simple such as the design of the present invention. Because of its simple shape, the cast steel components of the present invention can be successfully cast without dilution with sand and the pattern cost is very low.

In certain types of presses, iron is generally unsuitable as a construction material. One of these types is the "C" frame press also called a "gap frame press". The gap frame press is indispensable for certain operations. It differs from most press designs because it has to resist the forces acting on it by means of a cantilever type of construction. These forces are much the same as those acting on the common "C" clamp, which if made of brittle cast iron would break much easier than the same clamp made of steel.

The present invention combines the economy of cast iron construction with the strength of steel due to the design of the channels used as cantilever beams. These channels are able to be cast of steel because the simplicity of their shape enables them to be cast without breaking down the upper part of the mold and mixing the molten steel with the sand. In this way, consistent physical properties are attained in the beams from casting to casting. Also, the simplicity of the channel shaped cross section of the beams enables patterns to be made at very low cost.

The invention also provides a means to vary the bed height, the height of the die space and the width of the press at reasonable cost by means of modular construction techniques. The invention also provides a C-shaped frame with an open back as well as a guided ram assembly.

From the following detailed description, subjoined claims and drawings, other objects and advantages of the present invention will become apparent to those skilled in the art.

DETAILED DESCRIPTION OF THE PREFERRED EMBODIMENT

Figure 1:
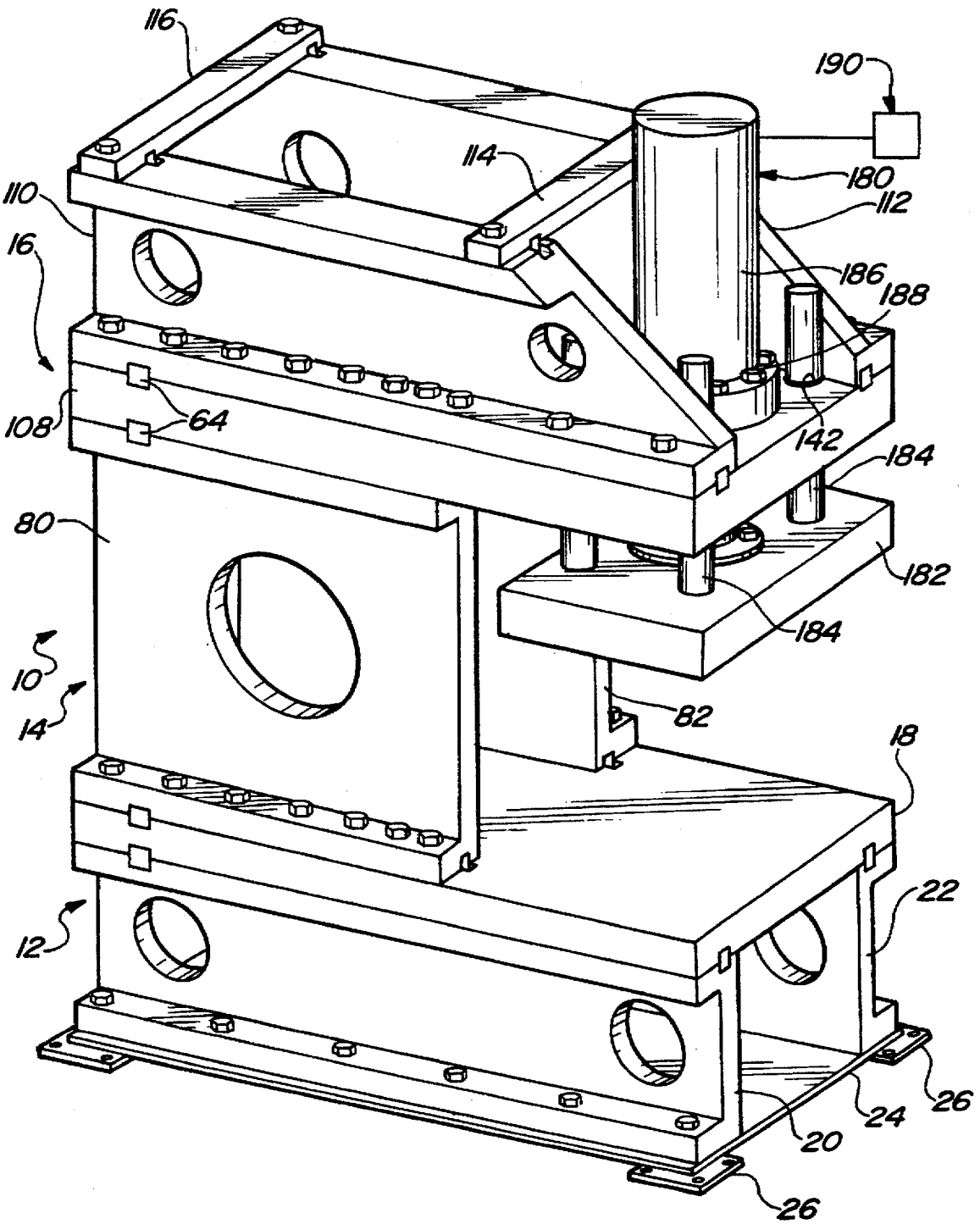
FIG. 1 is a perspective view of a modular gap frame press assembly in accordance with the present invention.
Figure 2:
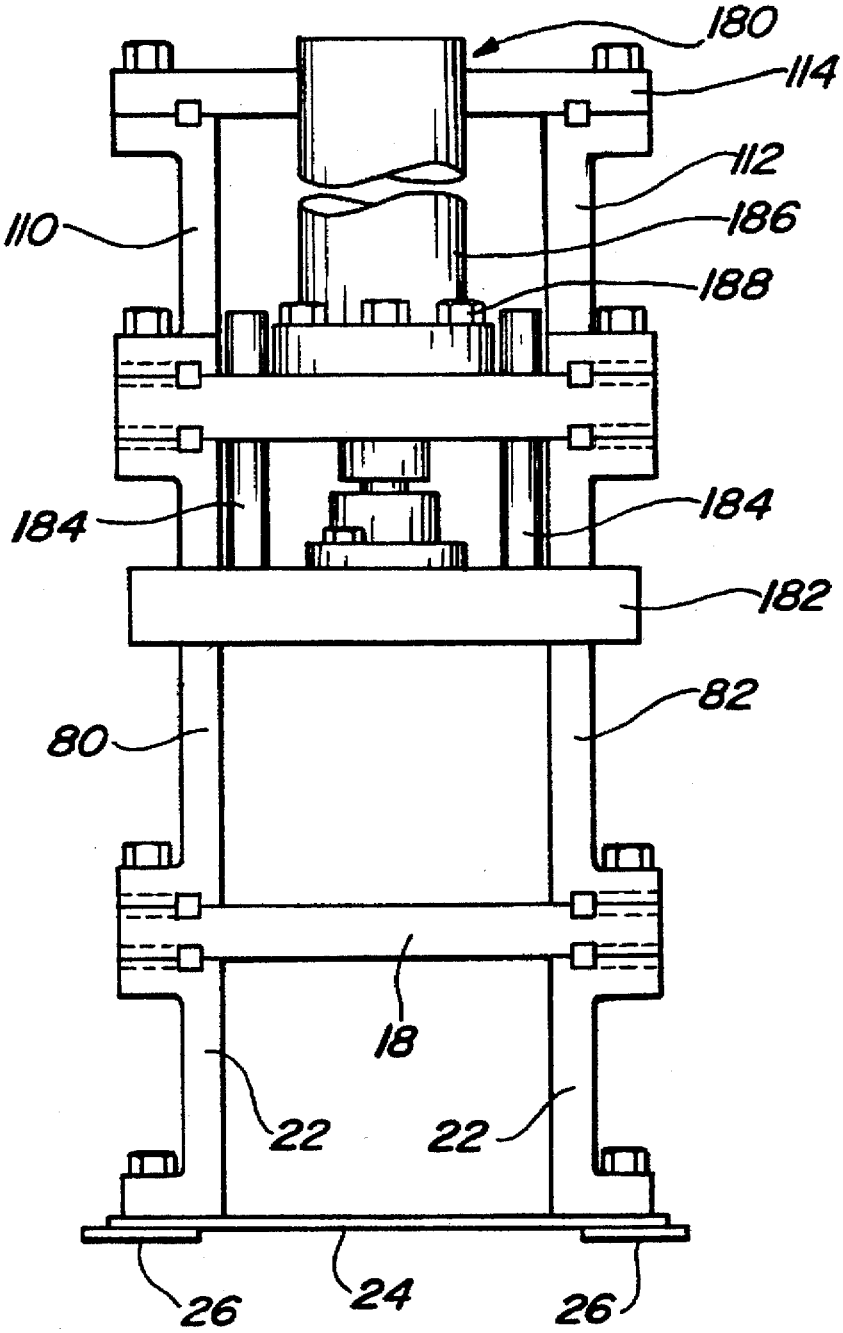
FIG. 2 is a front plan view of the press assembly of FIG. 1.
Figure 3:
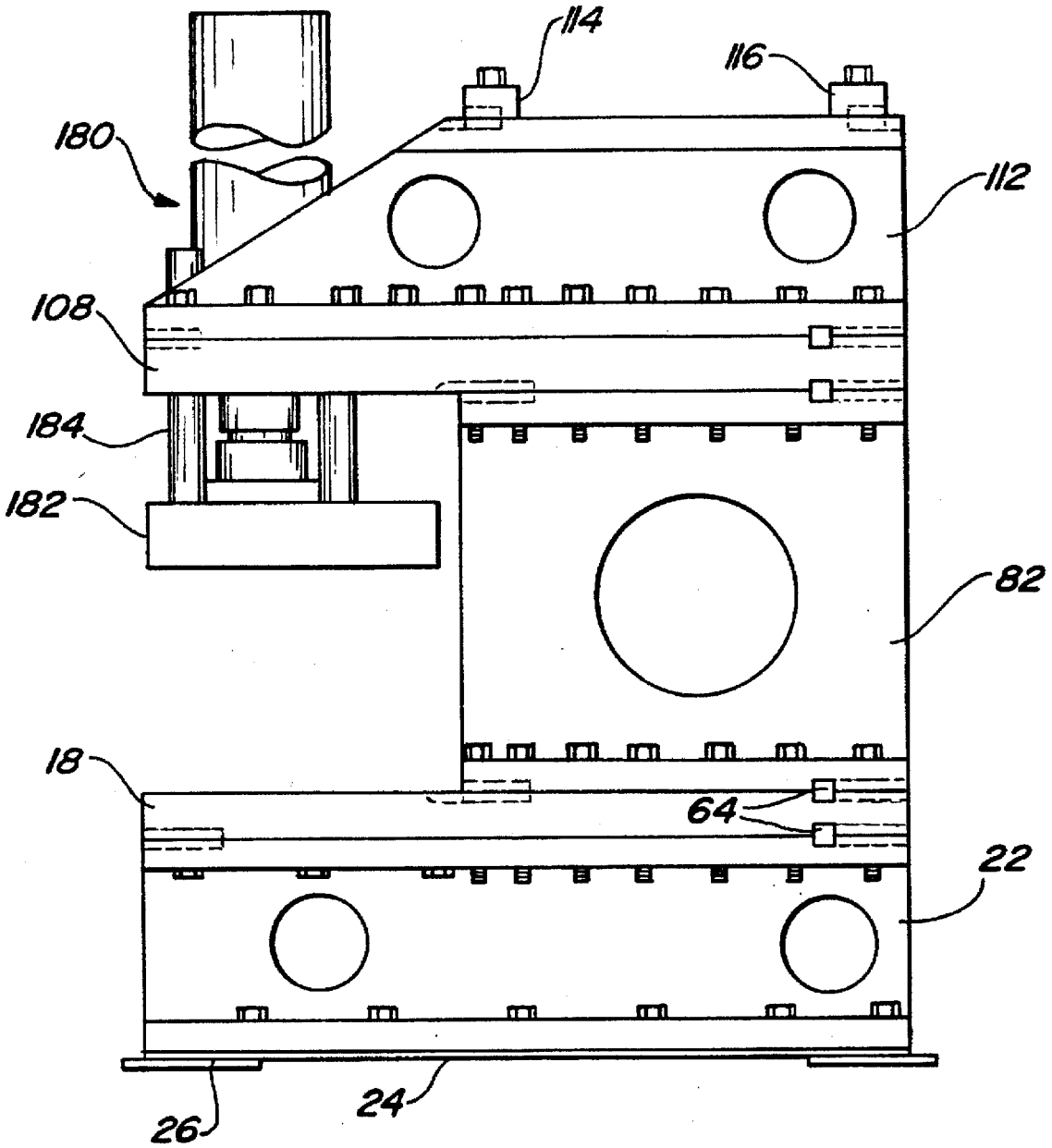
FIG. 3 is a side plan view of the press assembly of FIG. 1.
Figure 4:
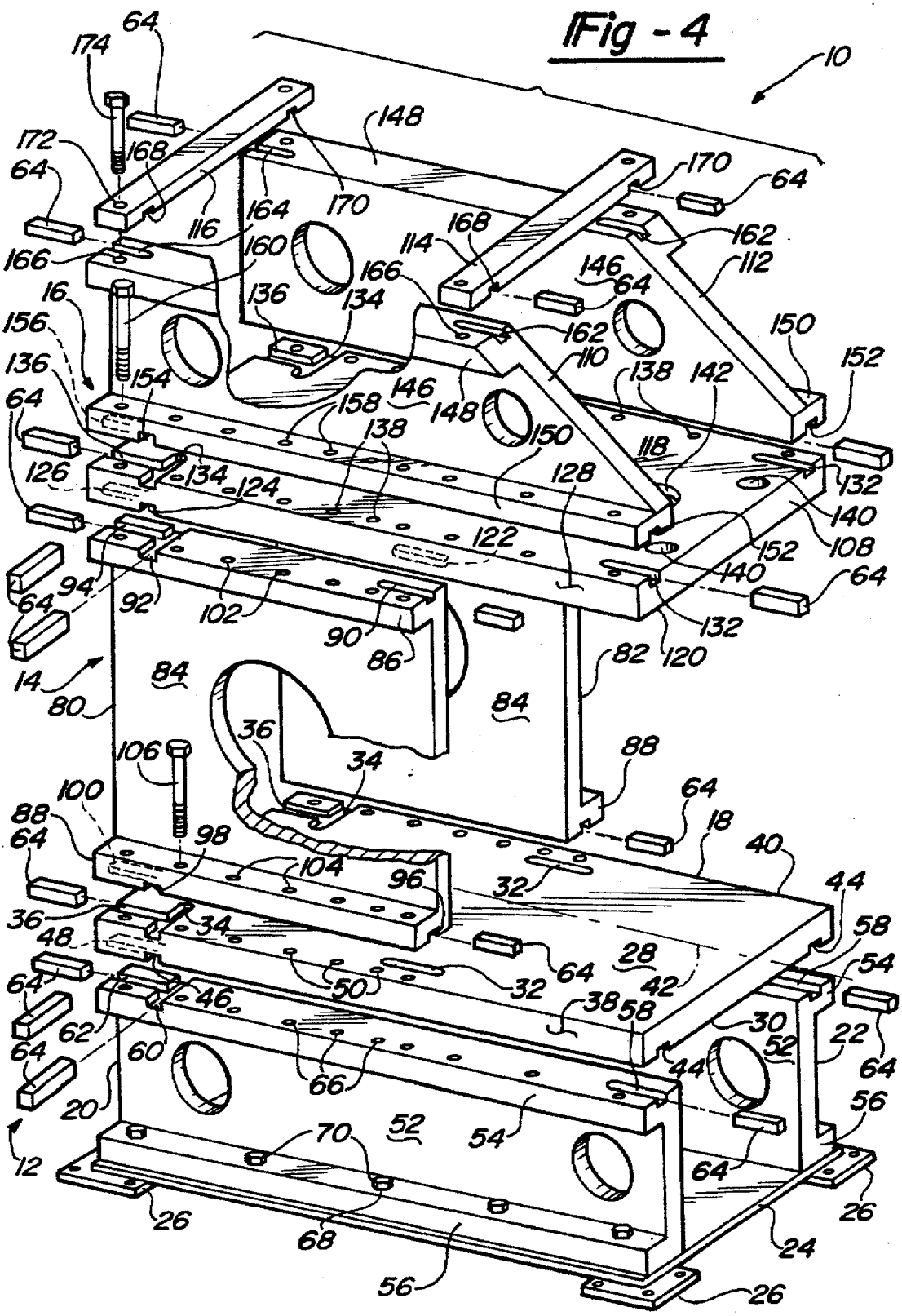
FIG. 4 is an exploded view of the press assembly of FIG. 1.

Referring to the drawings, preferably FIGS. 1 through 4, a press assembly is illustrated and designated with the reference numeral 10. The press 10 includes a base assembly 12, a support assembly 14, and a upper platform assembly 16. The three are combined together to provide a C-shape frame when viewed in side elevation as illustrated in FIG. 3.

The base assembly 12 includes a bed 18 supported by a pair of lower beams 20 and 22 which, in turn, are secured with a base plate 24. Feet 26 are secured to the base plate 24 to lift the base off of the ground and to provide a contact surface with the ground. Ordinarily, the feet are rectangular metal pieces which are welded to the base plate 24.

The bed 18 is a flat rectangular metallic plate. The metallic plate is ordinarily formed from commercial steel plate. The width of the bed may be changed by substituting a like bed with a larger width dimension. The plate, has a top surface 28 and a bottom surface 30. The top surface 28 has a plurality of key ways 32, 34 and 36 cut into the top surface of the plate along both its longitudinal sides 38 and 40. The key ways 32 and 36 are substantially coaxial and extend parallel to the longitudinal axis 42 of the plate 18. The key ways 34, which adjoin key ways 36, are perpendicular to the axis 42. As will be explained herein, the key ways are utilized to prohibit longitudinal and lateral shifting of the components with respect to one another.

The bottom surface 30 of the bed 18 includes a plurality of key ways 44, 46 and 48 along the longitudinal sides 38 and 40 of the bed 18. The key ways 44 and 48 are parallel with the longitudinal axis 42 while the key ways 46, which adjoin the key ways 48, are perpendicular to the axis 42.

Also, the bed 18 includes a plurality of apertures 50 to enable passage of fasteners to secure components together.

The lower frame beams 20 and 22 are cast steel channels. The frame beams 20 and 22, which are mirror images of one another, include a web 52 with flanges 54 and 56 on each side of the web. The flanges 54 include a plurality of key ways 58, 60 and 62 aligned with and opposing key ways 44, 46 and 48 of plate 18. The opposing key ways 44, 58, 46, 60, and 48, 62, receive keys 64 which are frictionally held in the key ways to secure the lower frame beams 20 and 22 with the bed 18 as well as to prevent longitudinal and lateral movement or shifting with respect to one another. Also, the flange 54 includes a plurality of apertures 66 to receive fasteners to connect the lower frame rails 20 and 22 with the bed 18. The flange 56 includes a plurality of apertures 68 to enable passage of fasteners 70 to secure the lower frame rails 20 and 22 with the base plate 24. Also, if desired, key ways could be formed in the web 56 to secure it with the frame 24 as described above.

The base plate 24 is ordinarily a flat rectangular metallic member. The base plate 24 is formed from commercial steel plate and is utilized to support the lower frame beams 20 and 22 as well as to stabilize the press. The base plate 24 includes apertures, not shown, to receive fastener 70 to enable the fasteners 70, such as bolts, to pass through the base plate 24 to enable removable securement of the base plate with the lower frame beams 20 and 22. Also, the base plate 24 may have key ways like those mentioned above to enable keys to secure the lower web 56 with the base plate 24.

The lower frame beams 20 and 22 may be substituted with other frame beams (not shown) which have identical flanges and webs of different widths to adjust the height of the bed 18. Thus, various lower frame rails having different web sizes may be substituted one for the other to raise or lower the bed height 18 so that various types of operations may be performed by a single press.

The support assembly 14 includes a pair of support uprights 80 and 82. The support uprights 80 and 82 are C-shaped beams having a web 84 and flanges 86 and 88. The uprights 80 and 82 are identical to one another. Both the flanges 86 and 88 include a plurality of key ways 90, 92, 94 and 96, 98, 100, respectively. The key ways on flange 88 oppose key ways 32, 34, 36 on the bed 18. The opposing key ways 32 and 96, 34 and 98, 36 and 100 receive keys 64 which secure the uprights 80 and 82 with the bed 18, as well as prohibit lateral and longitudinal shifting with respect to one another. Also, the flanges 86 and 88 have a plurality of apertures 102 and 104 respectively for receiving fasteners to secure the press together. The apertures 104 are aligned with apertures 50 and 66 so that bolts 106 pass therethrough to secure the uprights with the bed 18 and lower frame rails 20 and 22.

The upper platform assembly 16 includes an upper plate 108, upper beams 110 and 112, and stabilizing bars 114 and 116. The upper plate 108 includes a top surface 118 and a bottom surface 120. The bottom surface 120 includes a plurality of key ways 122, 124 and 126, along its longitudinal sides 128, which oppose key ways 90, 92 and 94. The key ways 94 and 122, 92 and 124, and 94 and 126 receive keys 64 which secure the upper plate 108 with the uprights 80 and 82 as well as prohibit lateral and longitudinal shifting with respect to one another.

The top surface 118 of the plate 108 includes a plurality of key ways 132, 134 and 136. The key ways 132 and 136 are parallel with the longitudinal axis of the plate 108 in the key ways 134, which adjoin key ways 136, are perpendicular to the axis of the plate. Also, the upper plate 108 includes a plurality of apertures 138 which receive fasteners to secure the upper plate with the upper frames and supports 80 and 82. Further, the upper plate includes apertures 140 and 142 which act as guide apertures and a receiving aperture for the hydraulic cylinder of the ram assembly.

The base plate, bed, and upper plate may be changed to wider or narrower ones to provide presses of different width.

The upper frame beams 110 and 112, which are mirror image to one another, have a web portion 146 and flanges 148 and 150. Flanges 150 have a bottom surface with a plurality of key ways 152, 154 and 156. The key ways 152, 154 and 156 oppose key ways 132, 134 and 136. Thus, key ways 132 and 152, 134 and 154, and 136 and 156 receive keys 64 to secure the upper frame beams 110 and 112 with the upper plate 108 as well as to prohibit lateral and longitudinal movement with respect to one another. Also, flanges 150 include apertures 158 which align with apertures 138 and apertures 102 in the top plate 108 and uprights 80 and 82 respectively to receive bolts 160 to removably secure the upper frame beams 110, 112 with the top plate 108 and uprights 80 and 82. The upper flanges 148 include a pair of key ways 162 and 164. The key ways 162 and 164 are axially positioned along the flange and are parallel with the axis of the upper plate. While these beams could be exactly the same shape as numbers 20 and 22, they are bevelled to reduce superfluous weight (and cost). The ripper flanges 148 include apertures 166 to receive fasteners to retain the stabilizers 114 and 116 with the upper frame beams 110 and 112.

The stabilizers 114 and 116 are rectangular shaped bar members having key ways 168 and 170. The key ways 168 and 170 oppose key ways 162 and 164 to receive keys 64 to secure the stabilizers with the upper frame beams as well as to prohibit lateral movement with respect to one another. Also the stabilizers include apertures 172 to receive fasteners 174 to removably fasten the stabilizers 114, 116 with the upper frame beams 110 and 112.

The keys 64 are ordinarily square cross-sectioned keys and are identical such that the key ways are of identical size and depth to enable interchangeable keys 64 to be used in any of the key ways or key way connections throughout the assembly.

The ram assembly 180 includes a ram plate or platen 182, guide posts 184 which are secured to the ram plate 182, and a hydraulic cylinder 186. The guide posts 184 are guided in apertures 140 and the hydraulic cylinder 186 is positioned through the aperture 142. The hydraulic cylinder is secured to the upper plate 108 via removable fasteners 188. The hydraulic cylinder 186 is connected with a control mechanism 190 which controls the movement of the ram up and down on the C-shaped or gap frame press. Also, dies, not shown, may be positioned on the bed 1B as well as the underside of the ram plate 182 to perform a desired function on a workpiece, not shown, which is positioned between the dies.

Figure 5:
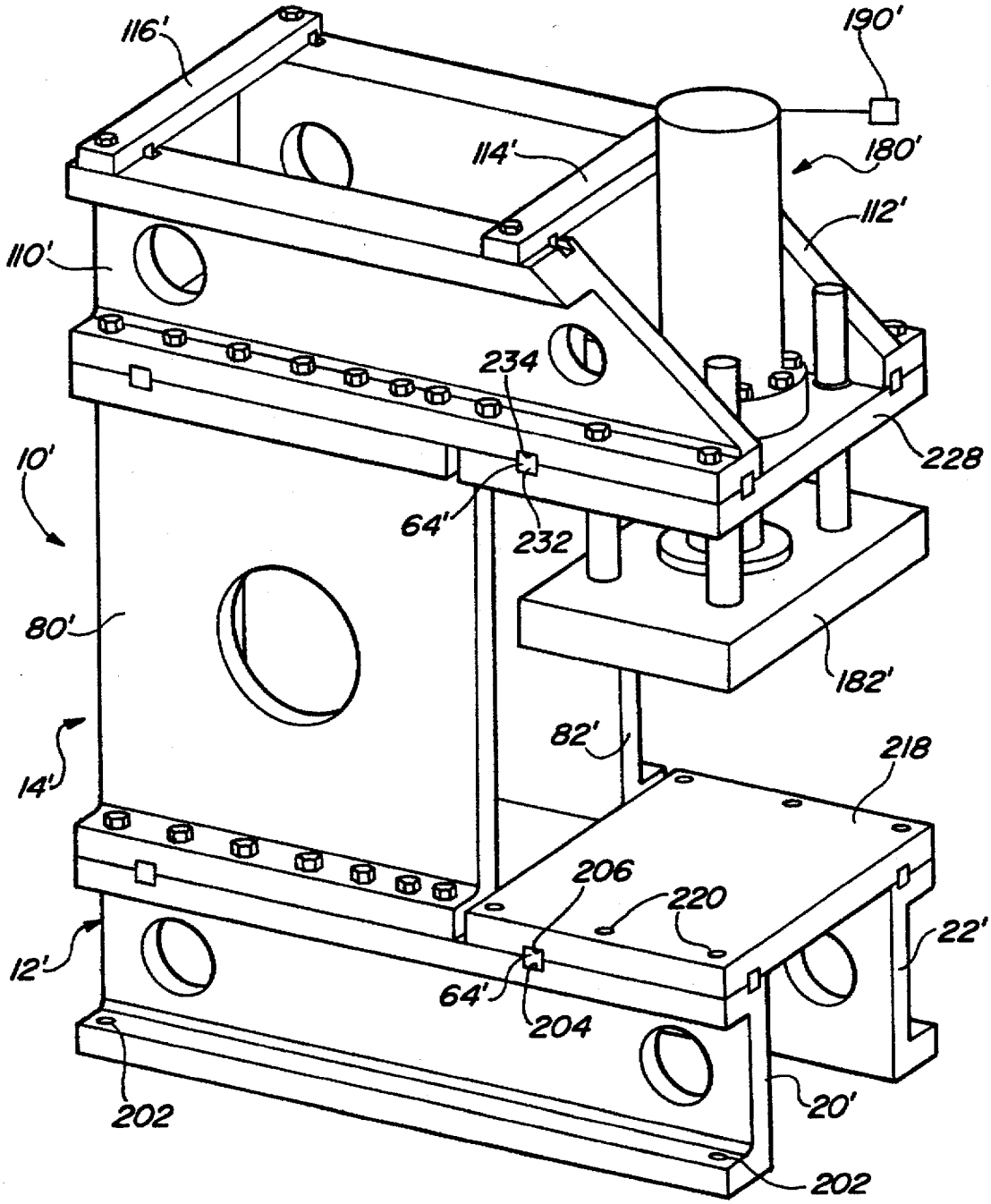
FIG. 5 is a perspective view of another embodiment of a modular gap frame press assembly in accordance with the present invention.

FIG. 5 illustrates an additional embodiment of a gap frame press in accordance with the present invention. Like elements have been identified with the same reference numeral with the reference numeral primed.

In FIG. 5, the base plate and feet have been removed. Here, the lower frame beams 20' and 22' include apertures 202 to enable the press 10' to be bolted or secured into a reinforced concrete foundation. The lower frame beams include additional key ways for securing the uprights 80' and 82' and the bed 218.

The bed 218 is substantially shortened and does not extend underneath the uprights as in the embodiment illustrated in FIGS. 1 through 4. Here, key ways 204, 206 are formed in the bed and lower frame beam, respectively, to receive a key 64' to prohibit lateral shifting of the bed with respect to the lower frame beams 20' 22' Also, the bed includes apertures 220 to enable fasteners (not shown) to pass therethrough to secure the bed with the lower frame beams 20', 22'.

Also, the upper plate 228 and upper frame beams 110' and 112' have been modified. Here, the upper frame beams have been modified to include a key way for receiving the uprights 80' and 82'. Also key ways 232 and 234 are formed in the upper plate and upper frame beam, respectively, to receive a key 64' to prohibit lateral shifting of upper plate 228 with respect to the upper frame beams 110' and 112'. The upper plate also includes apertures 236 to receive fasteners to secure the upper plate 228 with the upper frame beams 100' and 112'. The upper plate 228 is not sandwiched between the uprights 80' and 82' and upper frame beams 110' 112' as illustrated in FIGS. 1 through 4 above. Also, the uprights 80' and 82' may be increased in height. The remainder of the press assembly is like that previously described.

As can be seen, the press frame is formed from modular components which are removably secured together by keys and bolts. This enables the press to be easily manufactured as well as to have variable bed height. Also, the upper plate height may be varied, by substituting different sized upper supports or uprights, to adjust the platform height. Also the press can be altered to different widths by substituting different bases, beds and upper plates. The press has an opened C-shaped front to enable movement of a workpiece laterally across the press. Also, the press has an open back which enables longitudinal movement of a workpiece through the press. By providing modular components which are removably secured together, the press may be shipped and assembled on site.

While the above detailed description describes the preferred embodiment of the present invention, the invention is susceptible to modification, variation, and alteration without deviating from the scope and fair meaning of the subjoined claims.

What is claimed is:

1. A modular gap frame press comprising:

at least one first frame beam;

an elongated bed removably secured to said at least one first frame beam, said bed having a longitudinal axis;

upright support means removably secured to said bed and positioned on said bed to define an elongated opening, said elongated opening having a longitudinal axis parallel with said longitudinal axis of said bed, said opening enabling a work piece to be positioned in said opening and longitudinally movable with respect to said bed;

a platform removably secured to said upright support means and supported and positioned above said bed;

ram means for performing a pressing function, said ram means removably coupled with said platform;

at least one second frame beam removably secured with said platform for providing rigidity for said press, wherein said first and second frame beams, upright support means, bed, and platform are cut-to-size steel parts; and control means for operating said ram means.

2. The modular gap frame press according to claim 1 wherein fasteners including bolts, nuts and keys are used for securing said first frame beam, bed, upright support means, platform, ram means, and second frame beam to one another.

3. The modular gap frame press according to claim 1 wherein a plurality of different sized first frame beams may be substituted, one for another, to provide variable bed height.

4. The modular gap frame press according to claim 1 wherein a plurality of different sized upright supports means may be substituted, one for another, to provide variable platform height.

5. The modular gap frame press according to claim 1 wherein a plurality of different sized beds may be substituted, one for another, to provide variable bed width;

and wherein a plurality of platforms may be substituted, one for another, to provide variable platform width.

6. The modular gap frame press according to claim 1 wherein a base is removably secured with said at least one first frame beam.

7. A modular gap frame press comprising:

a pair of first frame beams, said pair of first frame beams spaced with respect to one another such that an opening is present between said first frame beams;

a bed removably secured along two longitudinal sides with said pair of first frame beams;

a pair of upright supports removably secured with said bed, said upright supports positioned on the longitudinal sides of said bed such that an opening is present between said upright supports, said opening enabling a work piece to be positioned between said uprights and longitudinally movable with respect to said bed, and said upright supports spanning a desired distance along said longitudinal sides such that an open work area with unblocked sides is available on said bed;

a platform positioned above said upright supports, said platform extending laterally from said upright supports and extending over said open work area;

ram means for performing pressing functions, said ram means removably secured with said platform over said work area;

a pair of second frame beams removably secured with said platform along longitudinal sides of said platform;

stabilizing means removably secured with said second frame beams for stabilizing the press;

control means for controlling movement of said ram means.

8. The modular gap frame press according to claim 7 wherein fasteners including bolts, nuts and keys are used for securing said first frame beams, bed, upright supports platform, ram means, second frame beams and stabilizing means to one another.

9. The modular gap frame press according to claim 7 wherein said first and second frame beams, upright supports, bed, and platform are cut-to-size steel parts.

10. The modular gap frame press according to claim 7 wherein said first pair of first frame beams are interchangeable with a plurality of pairs of first frame beams for adjusting the height of the bed.

11. The modular gap frame press according to claim 7 wherein key ways are formed in said first frame beams, bed, upright supports, platform and second frame beams such that key ways oppose one another in adjacent components and keys are secured in said key ways for prohibiting longitudinal and lateral movement of components with respect to one another.

12. The modular gap frame press according to claim 7 wherein said upright supports are interchangeable with a plurality of pairs of upright supports for adjusting the height of the upper platform.

13. The modular gap frame press according to claim 7 wherein said first frame beams, upright supports and second frame beams are steel channels.

14. The modular gap frame press according to claim 7 wherein said first beams, bed, uprights, platform and second beams are formed from cut-to-size components.

15. The modular gap frame press according to claim 14 wherein said first frame beams, upright supports, and second frame beams are formed from channel shaped beams.

16. The modular gap frame press according to clam 14 wherein said bed and platform are formed from flat plate metal plates.

17. The modular gap frame press of claim 7 wherein said ram means includes a platen having a plurality of guide bars extending from said platen riding in apertures in said platform, and a cylinder mounted on said platform and including a piston rod connected with said platen for moving said plate up and down, and said cylinder coupled with said control means for controlling the up and down movement of said platen.

18. The modular gap frame press according to claim 7 wherein a plurality of different sized beds may be substituted, one for another, to provide variable bed width;

and wherein a plurality of platforms may be substituted, one for another, to provide variable upper platform width.

19. The modular gap frame press according to claim 7 wherein a base is removably secured with said pair of first frame beams.

* * * * *